US005752597A

United States Patent [19]

Brangle, Jr.

[11] Patent Number: 5,752,597

[45] Date of Patent: May 19, 1998

[54] CARTON FOR STORAGE AND DISPLAY OF AN ARTICLE

[76] Inventor: Edward J. Brangle, Jr., 153 Regatta St., Melbourne Beach, Fla. 32951

[21] Appl. No.: 706,246

[22] Filed: Sep. 4, 1996

[51] Int. Cl.[6] ..... B65D 5/52

[52] U.S. Cl. ..... 206/45.21; 206/45.23; 206/806

[58] Field of Search ..... 206/45.2, 45.21, 206/45.23, 45.25, 766, 45.26, 767, 45.29, 806, 299; 229/108

[56] References Cited

U.S. PATENT DOCUMENTS

| | | | |
|---|---|---|---|
| 1,213,135 | 1/1917 | Kislovitz . | |
| 1,410,869 | 3/1922 | Allan | 206/45.21 |
| 1,416,465 | 5/1922 | Harvey | 206/45.21 |
| 1,609,186 | 11/1926 | Peruzzi | 206/45.29 |
| 1,956,642 | 5/1934 | Einson | 206/806 |
| 2,027,079 | 1/1936 | Weiss | 206/45.29 |
| 2,137,906 | 11/1938 | Cummings . | |
| 2,167,947 | 8/1939 | Hayes | 206/45.21 |
| 2,473,635 | 6/1949 | Buttery | 206/45.26 |
| 2,517,030 | 8/1950 | Ringler | 206/45.21 |
| 2,787,371 | 4/1957 | Curtis | 206/45.21 |
| 3,185,294 | 5/1965 | Lustman . | |
| 3,904,029 | 9/1975 | Koltz . | |
| 4,064,988 | 12/1977 | Mazie et al. | 229/108 |
| 4,121,752 | 10/1978 | Ravotto et al. . | |
| 4,308,986 | 1/1982 | Parrilli . | |
| 4,512,541 | 4/1985 | Lietzke . | |
| 4,579,220 | 4/1986 | Brundage . | |
| 4,579,232 | 4/1986 | Fedak . | |
| 5,193,671 | 3/1993 | Patterson . | |
| 5,322,167 | 6/1994 | Birutis et al. . | |
| 5,370,220 | 12/1994 | Wang | 206/806 |

*Primary Examiner*—Paul T. Sewell
*Assistant Examiner*—Nhan T. Lam
*Attorney, Agent, or Firm*—Howell & Haferkamp, L.C.

[57] ABSTRACT

A carton, configured for storage and display of an article, such as a pair of children shoes, comprises a box formed from a single unitary blank of fiberboard. The box has side walls, a forward end wall, a rearward end wall, a bottom, and a top. The side walls, end walls, and bottom define a box interior. The top includes a top panel, and a closure flap hinged to one of the top panel and rearward end wall along a hinge line. The closure flap is configured for pivotal movement about the hinge line between a closed position in which the closure flap extends forward from the hinge line to the forward end wall and an open position in which the closure flap is spaced from the forward end wall to provide access to the box interior. The closure flap includes a connector configured for releasably engaging the forward end wall to releasably secure the closure flap to the forward end wall when the flap is in its closed position and configured for releasably engaging the bottom to releasably secure the closure flap to the bottom when the flap is in its open position.

25 Claims, 6 Drawing Sheets 20
22
24
26
28
30
32
34
36
38
40
42
44
46
48
50
52
54
56
58
60
62
64
66
68
70
72
74
76
78
80
82
84
86
88
90
92
94
96
100
102
106
108
110
112
114
116
118
120
122
124
126
128

116
110
118
94
34
124

38
24
34
76
106
130
84

126
94
128
30
118
124
110
96
24
38
34
130
76
106

30
48
92
46
34
50
44
24

CARTON FOR STORAGE AND DISPLAY OF AN ARTICLE

BACKGROUND OF THE INVENTION

This invention relates generally to fiberboard containers, and more particularly to fiberboard cartons or boxes for storage and display of an article.

Paperboard shoe boxes are often used as containers for storage of shoes. Conventional shoe boxes have a bottom, four side walls extending up from the bottom and defining an open top, and a separate box lid sized for covering the open top. In shoe stores, it is usually desirable to display shoes in a manner than will attract the attention of customers. Often, the shoes are displayed in conventional shoe boxes with the box lids removed and placed under the box bottoms.

A disadvantage of conventional shoe boxes is that the manner in which shoes contained in such boxes can be displayed is limited. The boxes must generally be placed on a horizontal surface, with the open top facing upward to prevent the shoes from falling out of the box. Another disadvantage is that the box lids might become lost or misplaced.

SUMMARY OF THE INVENTION

Among the several objects of the present invention may be noted the provision of an improved carton or box for storage and display of an article such as a pair of children shoes which overcomes the disadvantages associated with conventional shoe boxes; the provision of such a carton which facilitates display of the article contained therein in many different positions or orientations; the provision of such a carton configured for facilitating suspension of the box from a hanger member; the provision of such a carton configured for securing a lid of the carton to another portion of the carton to releasably hold the lid in an open position; the provision of such a carton which is easy to fabricate; and the provision of such a carton which is of relatively simple and inexpensive construction.

Generally, a carton of the present invention is configured for storage and display of an article, such as a pair of children shoes. The carton comprises a box formed from a single unitary blank of fiberboard. The box has side walls, a forward end wall, a rearward end wall, a bottom, and a top. The side walls, end walls, and bottom define a box interior. The top includes a top panel, and a closure flap hinged to one of the top panel and rearward end wall along a hinge line. The closure flap is configured for pivotal movement about the hinge line between a closed position in which the closure flap extends forward from the hinge line to the forward end wall and an open position in which the closure flap is spaced from the forward end wall to provide access to the box interior. The closure flap includes a connector configured for releasably engaging the forward end wall to releasably secure the closure flap to the forward end wall when the flap is in its closed position and configured for releasably engaging the bottom to releasably secure the closure flap to the bottom when the flap is in its open position.

In another aspect of the present invention, a carton for storage and display of an article comprises a box having side walls, a forward end wall, a rearward end wall, a bottom, and a top. The top includes a top panel, and a closure flap hinged to one of the top panel and rearward end wall along a first hinge line, the closure flap being configured for pivotal movement about the hinge line between a closed position in which the closure flap extends forward from the hinge line to the forward end wall and an open position in which the closure flap is spaced from the forward end wall to provide access to the box interior. The carton further includes a suspension flap hinged to the forward end wall along a second hinge line. The suspension flap is configured for pivotal movement about the second hinge line between a retracted position in which the suspension flap extends rearwardly from the forward end wall into the box interior and an extended position in which the suspension flap extends forward of the forward end wall. The suspension flap is configured for attachment to a hanger member when the suspension flap is in its extended position to facilitate suspension of the carton from the hanger member.

In yet another aspect of the present invention, a carton for storage and display of an article comprises a box having side walls, a forward end wall, a rearward end wall, a bottom, and a top. The top includes a top panel, and a closure flap hinged to one of the top panel and rearward end wall along a hinge line. The closure flap is configured for pivotal movement about the hinge line between a closed position in which the closure flap extends forward from the hinge line to the forward end wall and an open position in which the closure flap is spaced from the forward end wall to provide access to the box interior. The carton further includes a pair of tabs extending generally rearwardly from opposite side edges of the forward end wall, and a pair of side flaps extending from the side walls of the box and within the box interior. The side flaps are configured to engage the tabs to secure the forward end wall to the side walls.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
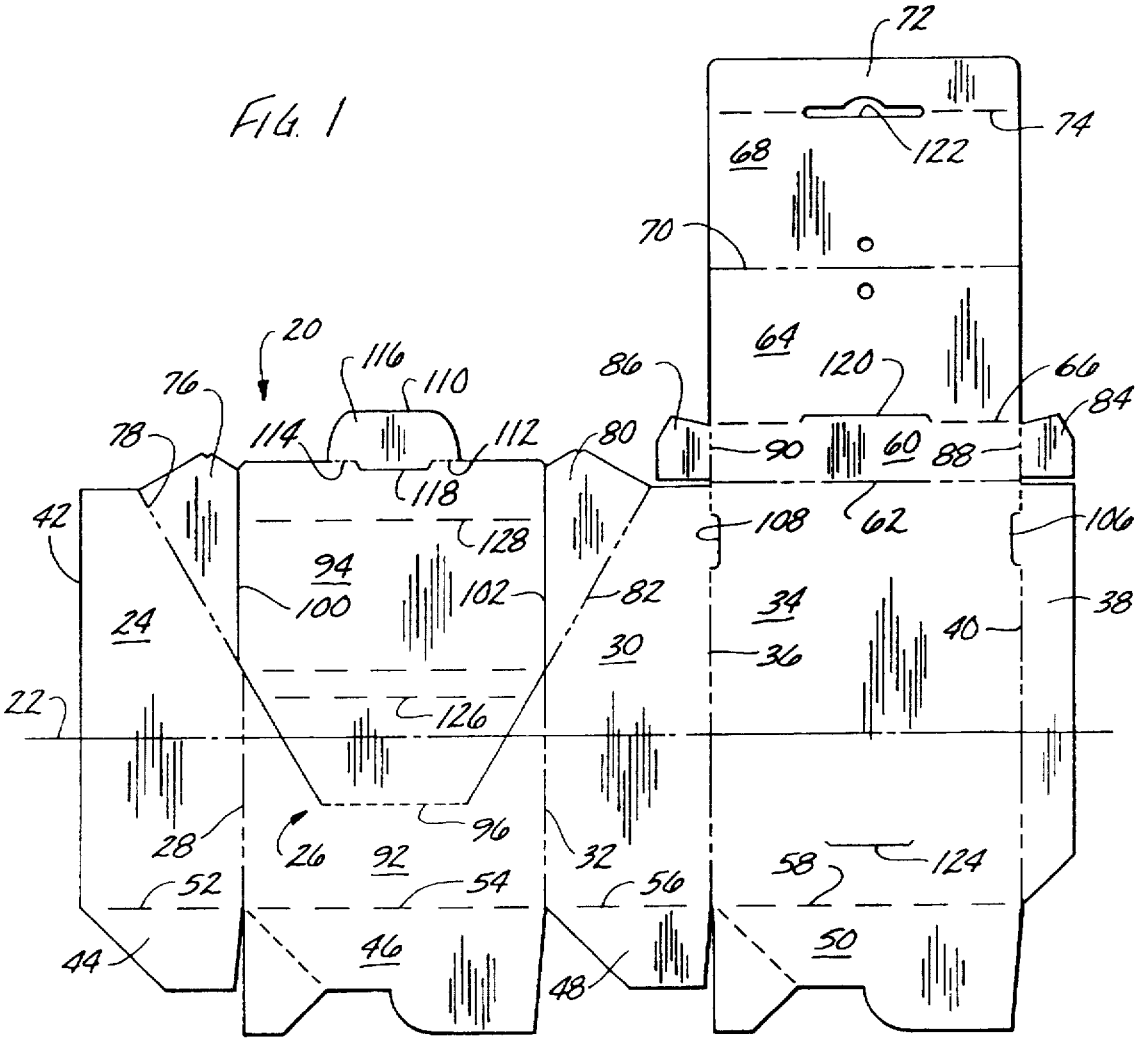
FIG. 1 is a plan view of a blank from which a carton of this invention is formed.

Referring now to the drawings, and first more particularly to FIG. 1, a blank from which a carton of the present invention is formed is indicated in its entirety by the reference numeral 20. A central reference line 22, running horizontally along the blank 20, is shown for convenience in FIG. 1 to facilitate an understanding of the respective orientations of the various components of the carton.

The blank 20 is die cut and scored in the usual manner from a fiberboard material, such as cardboard, to define walls, panels and flaps of the carton. A first side wall 24 is integrally hinged to a top 26 along a vertical score line 28. A second side wall 30 is integrally hinged to the top 26 along a vertical score line 32 and to a bottom 34 along a vertical score line 36. A first glue flap 38 extends laterally from the bottom 34 along a vertical score line 40. The first glue flap 38 is adapted to be secured to the first side wall 24 immediately adjacent a vertical edge 42 (the left-most edge as viewed in FIG. 1) of the first side wall.

First, second, third, and fourth rearward end flaps, 44, 46, 48, 50, respectively, constitute a rearward end wall of the ultimate carton. The first rearward end flap 44 is integrally hinged to the rearward edge of the first side wall along a horizontal score line 52. The second rearward end flap 46 is integrally hinged to the rearward edge of the top 26 along a horizontal score line 54. The third rearward end flap 48 is integrally hinged to the rearward edge of the second side wall 30 along a horizontal score line 56. The fourth rearward end flap 50 is integrally hinged to the rearward edge of the bottom 34 along a horizontal score line 58.

A forward end wall 60 is integrally hinged to the forward edge of the bottom 34 along a horizontal score line 62. A first forward panel 64 is integrally hinged to the forward end wall 60 along a horizontal score line 66 and to a second forward panel 68 along a horizontal score line 70. A second glue flap 72 extends vertically from the second forward panel 68 along a horizontal score line 74. The first and second forward panels 64, 68 constitute a suspension flap of the ultimate carton. The second glue flap 72 is adapted to be secured to the forward end wall 60. Preferably, the score line 74 is parallel to and adjacent (i.e., substantially collinear with) the score line 66 when the second glue flap 72 is secured to the forward end wall 60 to allow the suspension flap of the ultimate carton to pivot along these score lines.

A first side flap 76 is integrally hinged to the first side wall 24 along a diagonal score line indicated at 78. A second side flap 80 is integrally hinged to the second side wall 30 along a diagonal score line indicated at 82. First and second side tabs 84, 86 extend laterally from opposite side edges of forward end wall 60. The first side tab 84 is integrally hinged to the forward end wall 60 along a vertical score line 88 and the second side tab 86 is integrally hinged to the forward end wall along a vertical score line 90. As discussed in greater detail below, the side flaps 76, 80 engage the tabs 84, 86 to maintain the forward end wall 60 of the ultimate carton generally perpendicular to the bottom 34.

The top 26 includes a top panel 92 and a closure flap 94. The closure flap 94 is integrally hinged to a forward edge of the top panel 92 along a horizontal line of weakness indicated at 96. Preferably, the line of weakness 96 comprises a line of perforation. The closure flap 94 is separated from the side flaps 76, 80 via vertical cut lines 100, 102.

Figure 5:
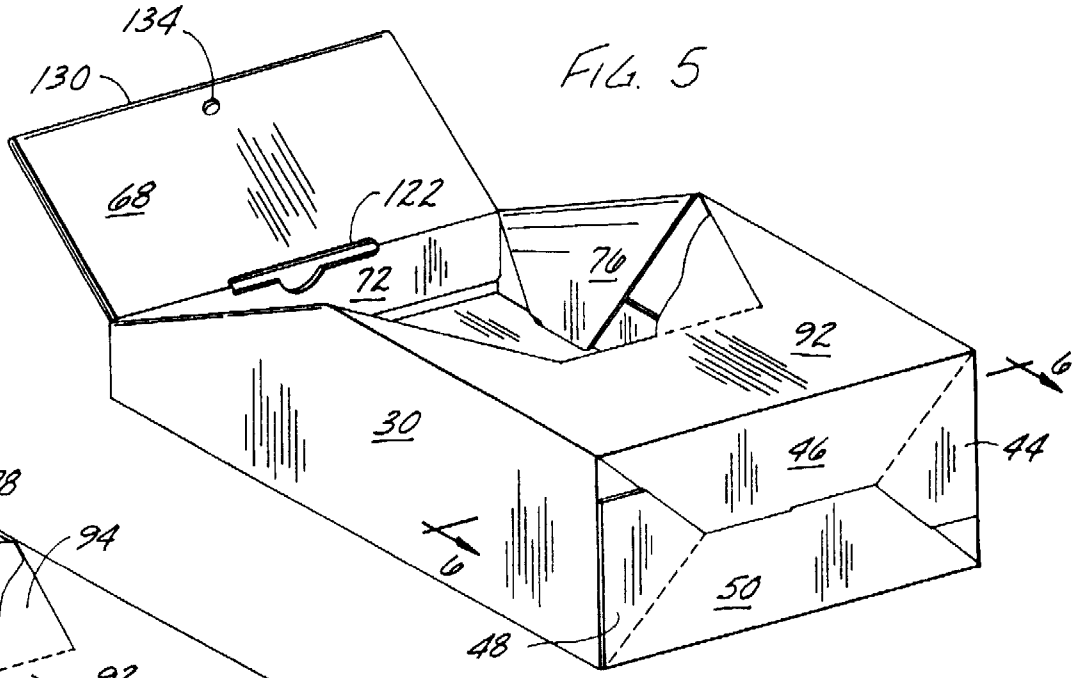
FIG. 5 is a perspective similar to FIG. 3 but showing rearward end flaps folded to close the rearward end of the box.
Figure 2:
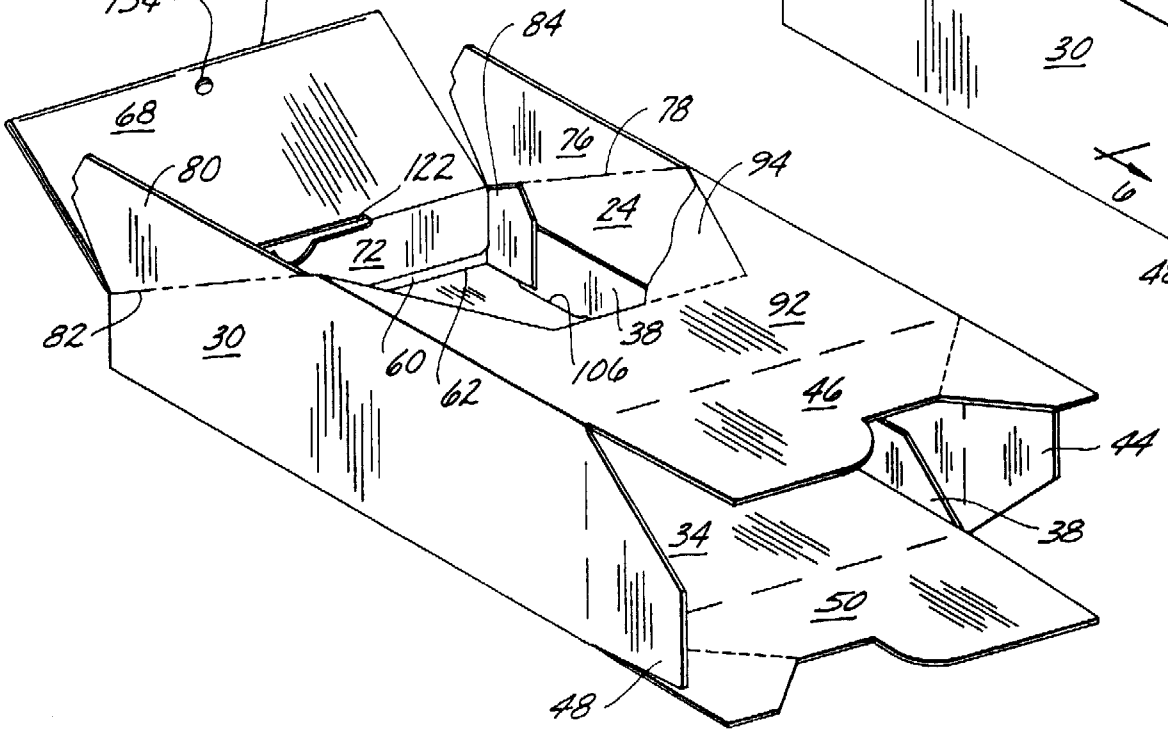
FIG. 2 is a perspective view of a partially folded box formed from the blank of FIG. 1, the box having a first glue flap affixed to a side wall and a second glue flap secured to a forward end wall, a closure flap being broken away to show portions of the inside of the box.
Figure 7:
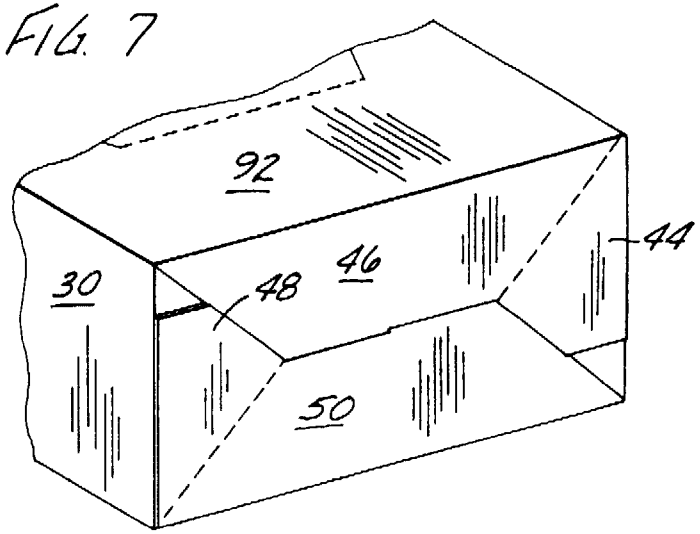
FIG. 7 is an enlarged, fragmented perspective view of the rearward end of the box of FIG. 5.
Figure 3:
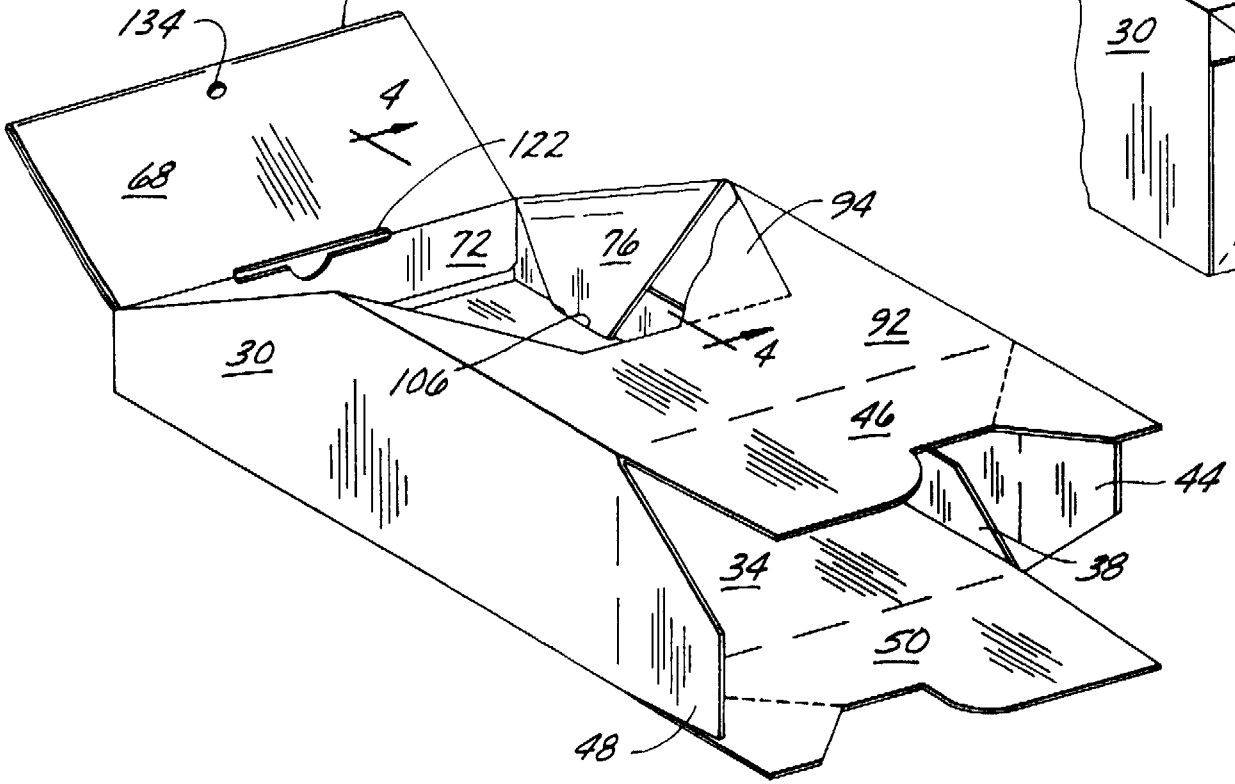
FIG. 3 is a perspective view similar to FIG. 2 but showing side flaps folded over side tabs extending rearward from the forward end wall.
Figures 4, 6, 11, 12:
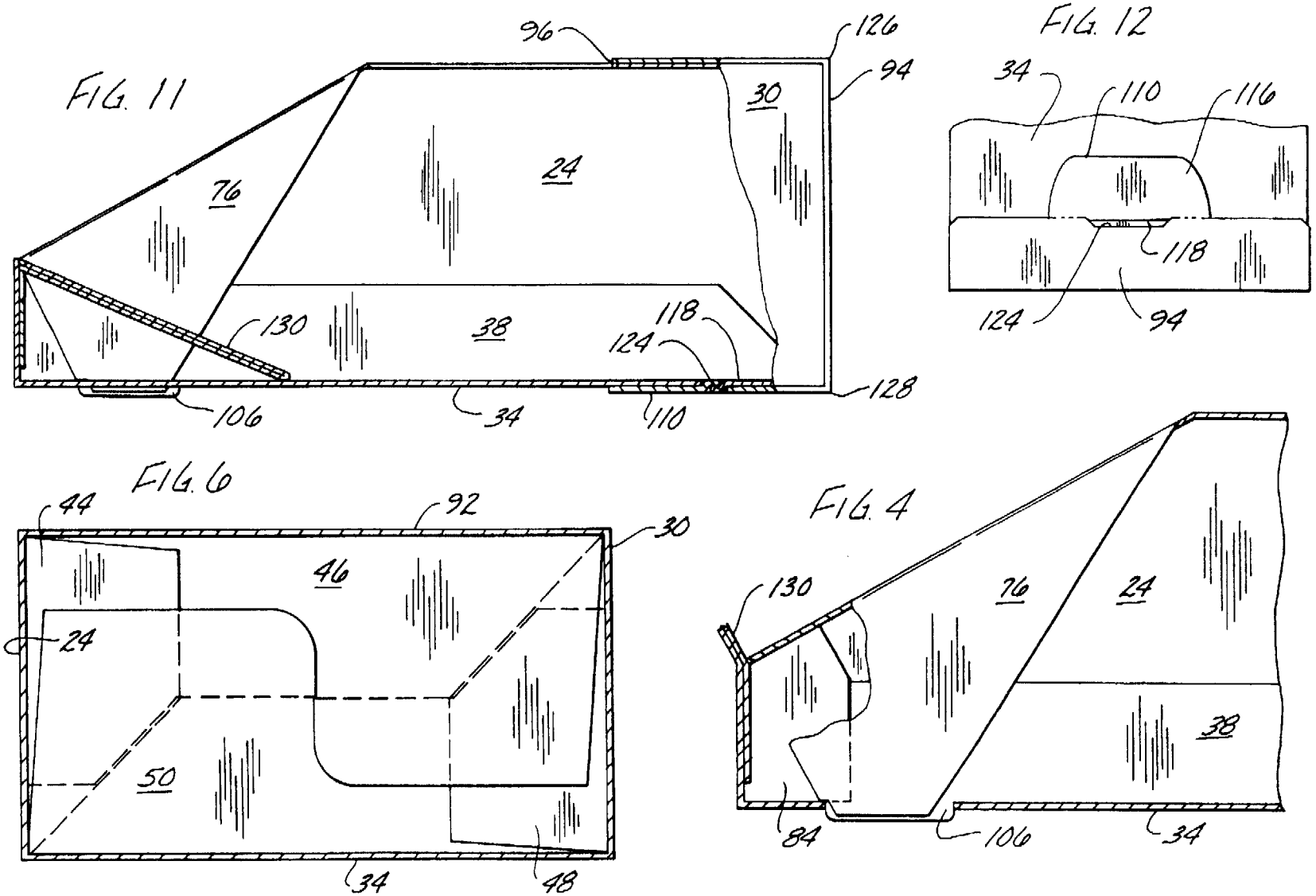
FIG. 4 is a fragmented cross-sectional view taken along the plane of line 4—4 of FIG. 3.
FIG. 6 is a cross-sectional view taken along the plane of line 6—6 of FIG. 5.
FIG. 11 is a cross-sectional view taken along the plane of line 11—11 of FIG. 10.
FIG. 12 is a fragmented, bottom plan view of the box of FIG. 10 showing the closure flap attached to the box bottom.
Figure 8:
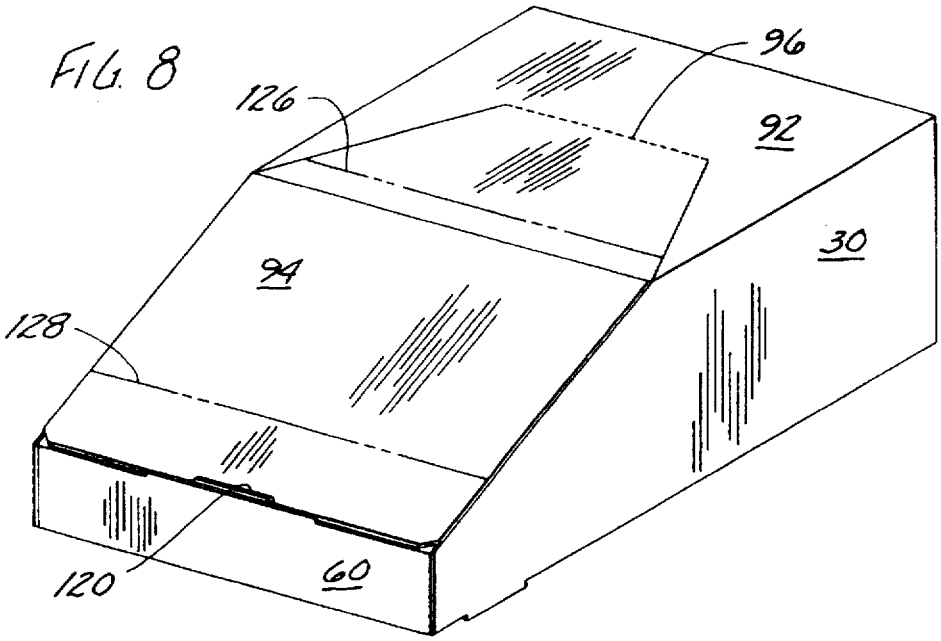
FIG. 8 is a perspective view of the box of FIG. 5 showing the closure flap in a closed position.

The blank 20 forms a box of the present invention for storage and display of an article, such as children shoes, the box being generally designated 104 in FIGS. 2–13. To form the blank 20 into the folded box 104, the side walls 24, 30, top 26, and bottom 34 are folded along respective vertical score (or hinge) lines and the first glue flap 38 is adhesively secured to an inside surface of the first side wall as shown in FIG. 2. The first and second forward panels 64, 68 are folded along their respective fold lines and the second glue flap 72 is adhesively secured to an inside surface of the forward end wall 60. As shown in FIG. 2, the forward end wall 60 is folded along the horizontal score line 62 and the tabs 84, 86 are folded along the vertical score lines 88, 90 so that the tabs are adjacent inner surfaces of the side walls 24, 30. The generally triangular-shaped side flaps 76, 80 are folded inward along the diagonal score lines 78, 82 to overlap the side tabs 84, 86 as shown in FIG. 3. Lower ends of the side flaps 76, 80 are inserted into vertical slots 106, 108 (see FIG. 4) cut or formed in the box bottom 34. The side flaps 76, 80 engage the tabs 84, 86 to interfere with outward movement of the forward end wall 60 relative to the box bottom 34 to thereby maintain the forward end wall perpendicular to the box bottom. As shown in FIGS. 5–7, the rearward end flaps 44, 46, 48, 50 are folded along their respective score lines to form a closure at the rearward end of the box 104.

Figure 9:
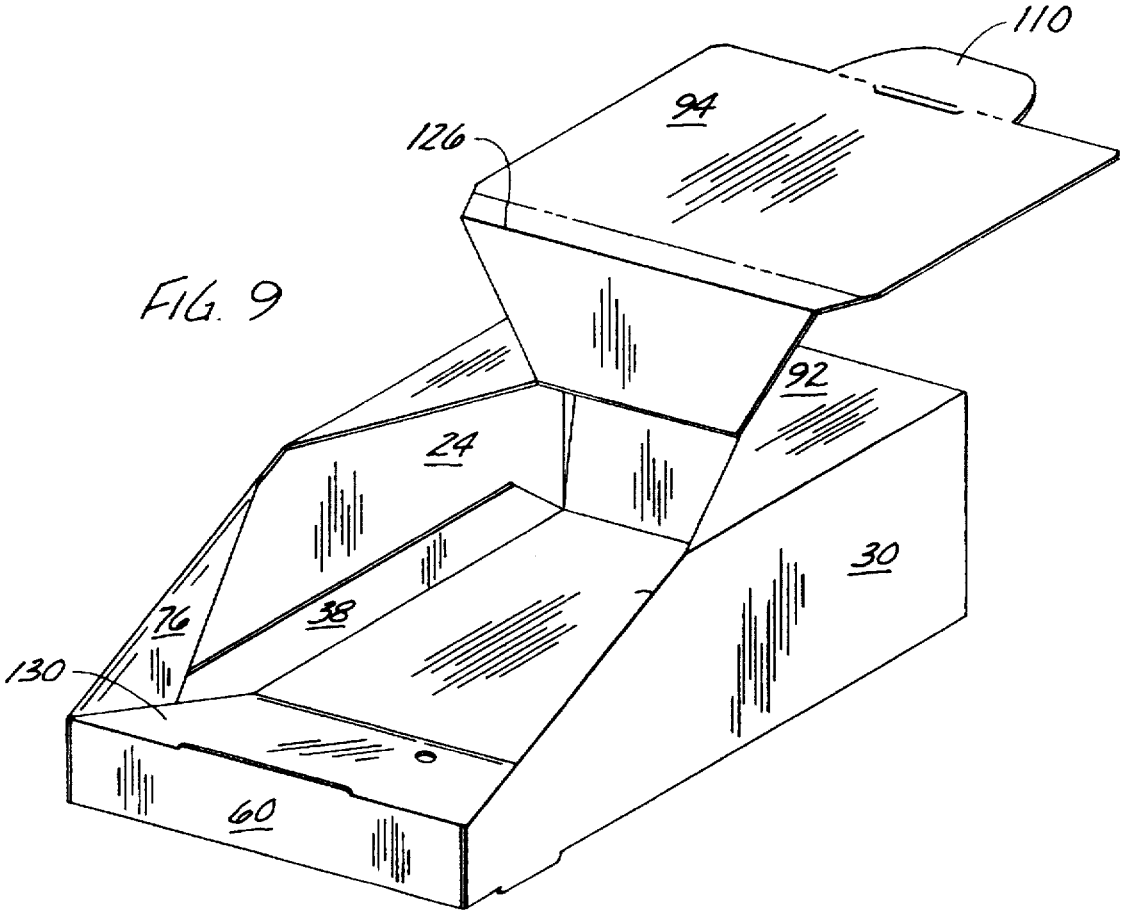
FIG. 9 is a perspective view of the box of FIG. 8 showing the closure flap in an open position.
Figure 10:
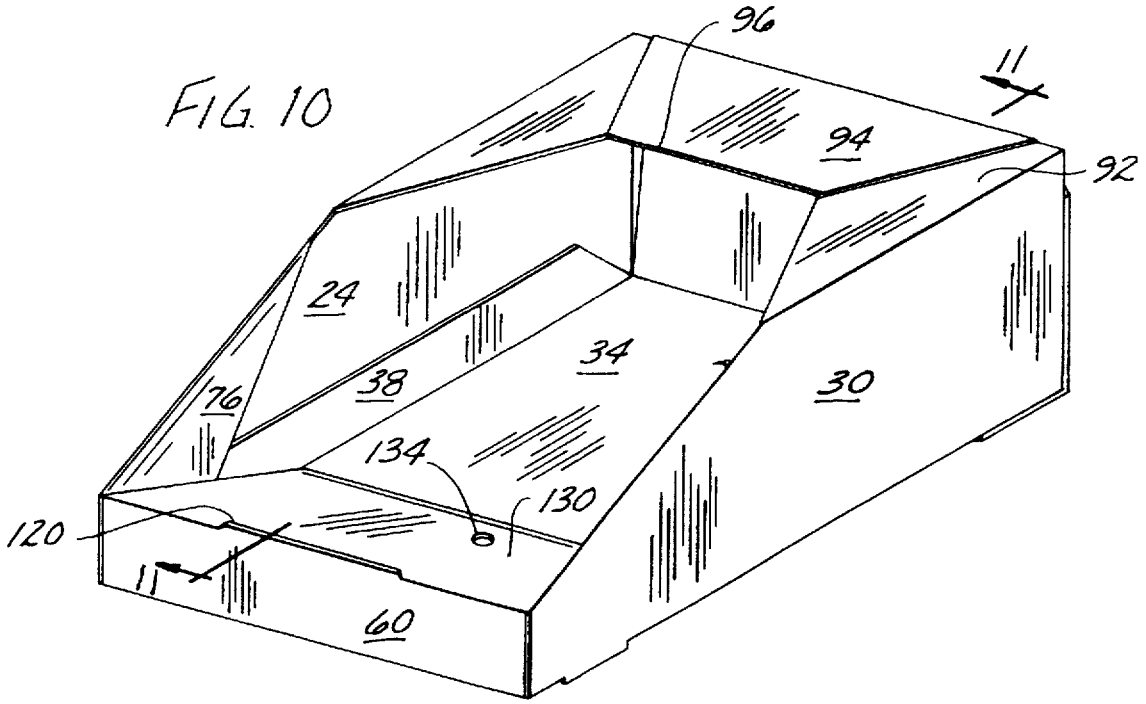
FIG. 10 is a perspective view of the box of FIG. 9 showing the closure flap folded around the rearward end of the box and attached to the underside of the box.

The closure flap 94 is preferably hinged to the top panel 92 via the line of weakness 96 for pivotal movement about the hinge line between a closed position (FIG. 8) and an open position (FIG. 9). In the closed position, the closure flap 94 extends forward from the hinge line to adjacent the forward end wall 60. In the open position, the closure flap 94 is spaced from the forward end wall to provide access to the box interior, the box interior being defined by the side walls, end walls, and bottom. The closure flap 94 includes a connector tab 110 hinged via horizontal score lines 112, 114 along a forward edge of the closure flap. The connector tab 110 includes a first tab portion 116 and a second tab portion 118. The first tab portion 116 is shaped and configured for extending into aligned slots 120, 122 in the forward end wall 60 and the glue flap 72 for releasably securing the closure flap 94 to the forward end wall 60 when the flap is in its closed position. As shown in FIGS. 10–12, the second tab portion 118 is shaped and configured for extending into a slot 124 in the bottom 34 to releasably secure the closure flap 94 to the bottom when the flap is in its open position. Preferably, the closure flap 94 includes first and second generally parallel score lines 126, 128. The first score line 126 is positioned so that when the closure flap 94 is in its open position and the second tab portion 118 is connected to the box bottom 34, then the first score line is generally adjacent an upper edge of the rearward end wall (i.e., adjacent the score line 54). The second score line 128 is positioned so that when the closure flap 94 is in its open position and the second tab portion 118 is connected to the box bottom 34, then the second score line is generally adjacent a lower edge of the rearward end wall (i.e., adjacent the score line 58).

After the box 104 is assembled, it may be used as a storage or shipping carton or to display articles (not shown) contained therein. When used as a shipping carton, the closure flap 94 is pivoted to its closed position (see FIG. 8) and the first portion of the connector tab 110 is inserted into the aligned slots 120, 122.

To display articles placed therein the box 104 is capable of being in any one of several configurations. To begin with, the closure flap 94 may be pivoted to its open position as shown in FIG. 9. The suspension flap (indicated by reference numeral 130) formed of the first and second forward panels 64, 68 is pivoted rearward into the box interior. Preferably, the side flaps 76, 80 bow inwardly to engage the side edges of the suspension flap 130 when the suspension flap is in this rearward (i.e., retracted) position to maintain the suspension flap in this position. Because of the engagement of the side flaps 76, 80 with the suspension flap 130, the suspension flap may be held by the side flaps in any one of several positions. In other words, the position of the suspension flap 130 may be varied by varying the vertical distance between the score line 70 and the box bottom 34 while being frictionally engaged by the side flaps. Articles placed at least partially on the suspension flap 130 are elevated (and thereby displayed more prominently) when the vertical distance between the score line 70 and the box bottom 34 are increased. As shown in FIGS. 10–12, the closure flap 94 may also be folded around the rearward end of the box, and the second tab portion 118 of the connector tab 110 may be inserted into the slot 124 to secure the closure flap to the underside of the box bottom 34. The closure flap 94 may also be severed (e.g., by being torn) along the line of weakness 96 and discarded. Of course, this would impair the future usefulness of the box as a shipping carton.

Figure 13:
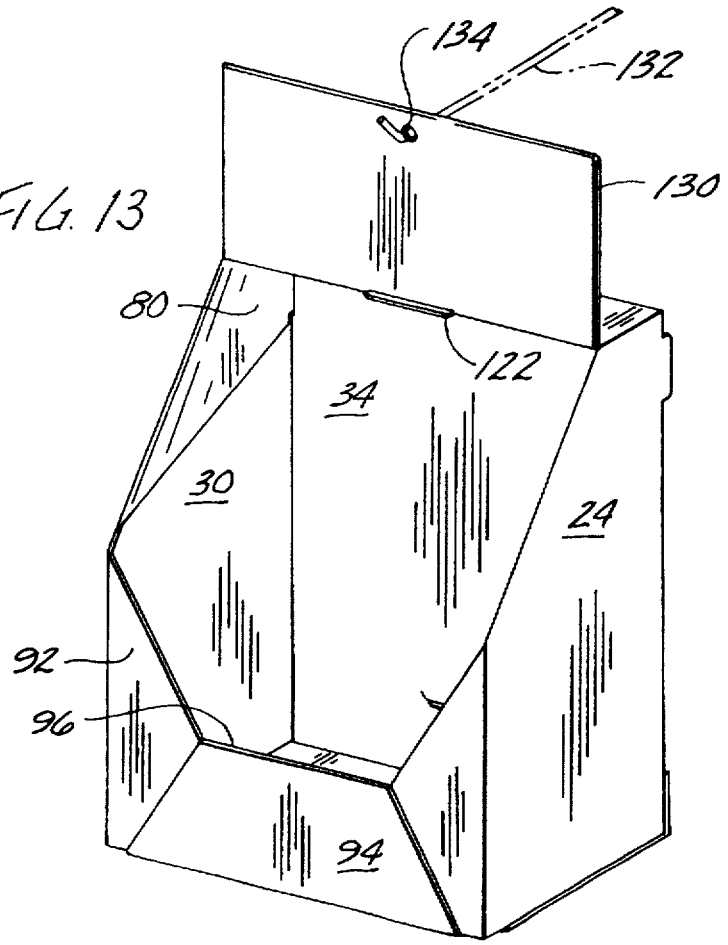
FIG. 13 is a perspective view showing the box of FIG. 10 suspended from a hanger member.

Referring now to FIG. 13, the suspension flap 130 is configured to be pivoted forwardly to a forward (extended) position to facilitate suspension of the box from a suitable hanger member 132 (shown in phantom in FIG. 13). Preferably, the suspension flap 130 includes a through aperture 134 for receiving the hanger member. The aperture constitutes means for attachment of the suspension flap to the hanger member for facilitating suspension of the box from the hanger member. Although the suspension flap 130 is shown with the aperture 134, it is to be understood that other attachment means may be employed without departing from the scope of this invention. For example, the suspension flap could include a hook or clip for securing the suspension flap to the hanger member.

Although the box is shown suspended from the hanger member 132 with the closure flap 94 in its open position, it is to be understood that the closure flap 94 could alternatively be pivoted to its forward position with the first tab portion 116 of the connector tab 110 inserted into the aligned slots 120, 122. Thus, the box is configured to permit insertion of the connector tab 110 into the aligned slots 120, 122 regardless of whether the suspension flap 130 is in its retracted or extended position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. The invention therefore shall be limited solely by the scope of the claims set forth below.

What is claimed is:

1. A carton for storage and display of an article comprising:

a box formed from a single unitary blank of carton material, the box having side walls, a forward end wall, a rearward end wall, a bottom, and a top, said side walls, end walls, and bottom defining a box interior;

said top including a top panel, and a closure flap hinged to the top panel along a hinge line, said closure flap being configured for pivotal movement about the hinge line between a closed position in which the closure flap extends forward from the hinge line to the forward end wall and an open position in which the closure flap is spaced from the forward end wall to provide access to the box interior;

said closure flap including a connector configured for releasably engaging the forward end wall to releasably secure the closure flap to the forward end wall when the flap is in its closed position and configured for releasably engaging the bottom to releasably secure the closure flap to the bottom when the flap is in its open position;

a first slot in the forward end wall and a second slot in the bottom, said connector of the closure flap comprising a connector tab, said connector tab including a first portion and a second portion, said first portion of the connector tab being configured for insertion into the first slot when the closure flap is in its closed position, said second portion of the connector tab being configured for insertion into the second slot when the closure flap is in its open position.

2. A carton as set forth in claim 1 wherein the hinge line is forward of and spaced from the rearward end wall, the closure flap including first and second generally parallel score lines positioned so that when the closure flap is in its open position, then the first score line is generally adjacent an upper edge of the rearward end wall and the second score line is generally adjacent a lower edge of the rearward end wall.

3. A carton as set forth in claim 1 wherein said hinge line comprises a line of weakness to facilitate separation of the closure flap from said top panel.

4. A carton as set forth in claim 1 further comprising a suspension flap hinged to the forward end wall along a second hinge line, said suspension flap being configured for pivotal movement about the second hinge line between a retracted position in which the suspension flap extends rearward from the forward end wall into the box interior and an extended position in which the suspension flap extends forward of the forward end wall, the suspension flap including means for attachment to a hanger member for facilitating suspension of the carton from the hanger member.

5. A carton as set forth in claim 4 wherein said closure flap is configured to cover said suspension flap when the suspension flap is in its retracted position and the closure flap is in its closed position.

6. A carton as set forth in claim 4 further comprising means for holding the suspension flap in its retracted position.

7. A carton as set forth in claim 6 wherein said means for holding the suspension flap in its retracted position comprises at least one side flap extending generally from one of the side walls to the bottom wall, said side flap being configured to engage the suspension flap when the suspension flap is in its retracted position.

8. A carton as set forth in claim 7 wherein said side flap is configured to frictionally engage an edge of the suspension flap.

9. A carton as set forth in claim 4 further comprising at least one side flap extending from one of the side walls and within the box interior, said side flap being configured to engage the suspension flap when the suspension flap is in its retracted position to thereby releasably retain the suspension flap in its retracted position.

10. A carton as set forth in claim 9 wherein the side flap is integrally joined to said one of the side walls along a fold line, said side flap further including an edge margin generally opposite the fold line secured to one of the bottom and said one of the side walls.

11. A carton for storage and display of an article comprising:

a box formed from a single unitary blank of carton material, the box having side walls, a forward end wall, a rearward end wall, a bottom, and a top, said side walls, end walls, and bottom defining a box interior;

said top including a top panel, and a closure flap hinged to the top panel along a hinge line, said closure flap being configured for pivotal movement about the hinge line between a closed position in which the closure flap extends forward from the hinge line to the forward end wall and an open position in which the closure flap is spaced from the forward end wall to provide access to the box interior;

said closure flap including a connector configured for releasably engaging the forward end wall to releaseably secure the closure flap to the forward end wall when the flap is in its closed position and configured for releasably engaging the bottom to releasably secure the closure flap to the bottom when the flap is in its open position;

a pair of tabs extending generally rearwardly from opposite side edges of the forward end wall and a pair of side flaps extending from the side walls of the box and within the box interior, said side flaps being configured to engage the tabs to secure the forward end wall to the side walls.

12. A carton as set forth in claim 11 wherein each side flap is integrally joined to one of the side walls along a fold line, said each side flap further including an edge margin generally opposite the fold line, said edge margin being secured to one of the bottom and said one of the side walls.

13. A carton as set forth in claim 12 wherein each tab is positioned between one of the side walls and one of the side flaps, said side flaps being configured to interfere with forward movement of the tabs.

14. A carton as set forth in claim 13 wherein the bottom is generally planar and wherein the fold line is slanted relative to said bottom.

15. A carton for storage and display of an article comprising:

a box formed from a single unitary blank of carton material, the box having side walls, a forward end wall, a rearward end wall, a bottom, and a top, said side walls, end walls, and bottom defining a box interior;

said top including a top panel, and a closure flap hinged to the top panel and along a first hinge line, said closure flap being configured for pivotal movement about the hinge line between a closed position in which the closure flap extends forward from the hinge line to the forward end wall and an open position in which the closure flap is spaced from the forward end wall to provide access to the box interior;

a suspension flap hinged to the forward end wall along a second hinge line, said suspension flap being configured for pivotal movement about the second hinge line between a retracted position in which the suspension flap extends rearwardly from the forward end wall into the box interior and an extended position in which the suspension flap extends forward of the forward end wall, the suspension flap being configured for attachment to a hanger member when the suspension flap is in its extended position to facilitate suspension of the carton from the hanger member.

16. A carton as set forth in claim 15 wherein said closure flap is configured to cover said suspension flap when the suspension flap is in its retracted position and the closure flap is in its closed position.

17. A carton as set forth in claim 15 further comprising at least one side flap extending from one of the side walls and within the box interior, said side flap being configured to engage the suspension flap when the suspension flap is in its retracted position to thereby releasably retain the suspension flap in its retracted position.

18. A carton as set forth in claim 17 wherein the side flap is integrally joined to said one of the side walls along a fold line, said side flap further including an edge margin generally opposite the fold line secured to one of the bottom and said one of the side walls.

19. A carton as set forth in claim 15 wherein said closure flap includes a connector configured for releasably engaging the bottom to releasably secure the closure flap to the bottom when the flap is in its open position.

20. A carton as set forth in claim 15 wherein the hinge line is forward of and spaced from the rearward end wall.

21. A carton for storage and display of an article comprising:

a box formed from a single unitary blank of carton material, the box having side walls, a forward end wall, a rearward end wall, a bottom, and a top, said side walls, end walls, and bottom defining a box interior;

said top including a top panel, and a closure flap hinged to the top panel and along a hinge line, said closure flap being configured for pivotal movement about the hinge line between a closed position in which the closure flap extends forward from the hinge line to the forward end wall and an open position in which the closure flap is spaced from the forward end wall to provide access to the box interior;

a pair of tabs extending generally rearwardly from opposite side edges of the forward end wall;

and a pair of side flaps extending from the side walls of the box and within the box interior, said side flaps being configured to engage the tabs to secure the forward end wall to the side walls.

22. A carton as set forth in claim 21 wherein each side flap is integrally joined to one of the side walls along a fold line, said each side flap further including an edge margin generally opposite the fold line, said edge margin being secured to one of the bottom and said one of the side walls.

23. A carton as set forth in claim 22 wherein each tab is positioned between one of the side walls and one of the side flaps, said side flaps being configured to interfere with forward movement of the tabs.

24. A carton as set forth in claim 22 wherein the bottom is generally planar and wherein the fold line is slanted relative to said bottom.

25. A carton as set forth in claim 21 wherein the hinge line is forward of and spaced from the rearward end wall.

* * * * *